US007283100B2

(12) United States Patent
Thompson et al.

(10) Patent No.: US 7,283,100 B2
(45) Date of Patent: Oct. 16, 2007

(54) SATELLITE ANTENNA

(75) Inventors: Loren M. Thompson, Lapeer, MI (US); Stephen D. Scott, Fenton, MI (US); Korkut Yegin, Grand Blanc, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 126 days.

(21) Appl. No.: 11/116,528

(22) Filed: Apr. 28, 2005

(65) Prior Publication Data

US 2006/0244667 A1 Nov. 2, 2006

(51) Int. Cl.
*H01Q 1/32* (2006.01)

(52) U.S. Cl. ..... 343/713; 343/700 MS

(58) Field of Classification Search ..... 343/700 MS, 343/713, 711, 712, 872
See application file for complete search history.

(56) References Cited

U.S. PATENT DOCUMENTS

| | | | | |
|---|---|---|---|---|
| 5,864,318 | A * | 1/1999 | Cosenza et al. | 343/700 MS |
| 6,023,245 | A * | 2/2000 | Gomez et al. | 343/725 |
| 6,936,191 | B2 * | 8/2005 | Fox et al. | 252/512 |
| 2005/0146072 | A1 * | 7/2005 | Aisenbrey | 264/104 |

* cited by examiner

*Primary Examiner*—Hoanganh Le
(74) *Attorney, Agent, or Firm*—Jimmy L. Funke

(57) ABSTRACT

An antenna structure and assembly is disclosed. The antenna structure includes a case that provides a capacitive coupling between a ground plane and a circuit board assembly that includes a low noise amplifier and satellite antenna. The case includes a metal impregnated thermoplastic resin. The ground plane may include at least one resilient fastener receiving portion that permits passage and frictional retention of at least one integrated fastening portion extending from the case. The antenna structure includes a cover portion placed over and ultrasonically welded to the case for encapsulating the circuit board assembly. A method for manufacturing the antenna structure is also disclosed.

3 Claims, 5 Drawing Sheets

SATELLITE ANTENNA

TECHNICAL FIELD

The disclosure generally relates to satellite antennas. More specifically, the disclosure relates to a satellite antenna with improved mechanical and electrical properties.

BACKGROUND

Automotive vehicles are becoming commonly equipped with antennas that receive and process signals other than traditional AM/FM signals, such as, for example, satellite signals. In particular, antennas relating to satellite digital audio radio services (SDARS), which is broadcast on the 2320-2345 MHz frequency band, is becoming widely available in vehicles as an originally-installed component by an original equipment manufacturer (OEM), or, alternatively, as an after-market component that is installed after the vehicle has been manufactured by the OEM.

SDARS offer a digital radio service covering a large geographic area, such as North America. Satellite-based digital audio radio services generally employ either geostationary orbit satellites or highly elliptical orbit satellites that receive up-linked programming, which, in turn, is re-broadcast directly to digital radios in vehicles on the ground that subscribe to the service. SDARS antennas, such as, for example, patch antennas, presently track two satellites at a time. Thus, the mounting location for SDARS patch antennas make antenna reception a sensitive issue with respect to the position of the antenna on a vehicle. As a result, SDARS patch antennas may be mounted exterior to the vehicle, usually on the roof.

SDARS antennas mounted on the roof of a vehicle have typically utilized the metallic roof structure as the antenna ground plane. For such applications, the antenna assembly is coupled to the vehicle roof either with a magnet or with a through-hole fastening structure. A conventional SDARS antenna including a through-hole fastening structure is shown generally at 100 in FIG. 5. The antenna assembly 100 includes an injection molded cover 102, a circuit board assembly 104, a gasket 106, a zinc die-cast case 108, and a first and second plurality of fastening elements 110, 112.

As illustrated, the first plurality of fastening elements 110 secure the circuit board assembly 104 to the zinc die-cast case 108 in a first manufacturing step. The second plurality of fastening elements 112 secure the zinc die-cast case 108 and the gasket 106 to the cover 102 in a second manufacturing step. When assembled, the gasket 106 seals off an opening created by the placement of the cover 102 adjacent a flange 114 of the zinc die-cast case 108 to protect the circuit board assembly 104 from the elements, contaminants, and the like. The zinc die-cast case 108 provides ground coupling between the circuit board assembly 104 and the vehicle roof.

Although adequate for most applications by ensuring good electrical coupling between the vehicle roof and a satellite antenna element 116, which is part of the circuit board assembly 104, such antenna assemblies 100 require many parts, which increase the overall cost of the assembly. Additionally, the first and second plurality of fastening elements 110, 112 require that the antenna assembly 100 be built over multiple assembling steps, which slows production, and hence, the amount of antenna assemblies 100 that may be manufactured. The proposed antenna structure departs from a conventional antenna assembly 100 by eliminating the following components and related processes: 1) fasteners to secure the circuit board assembly to case, 2) fasteners to secure cover to case, and 3) cover to case gasketing.

BRIEF DESCRIPTIONS OF THE DRAWINGS

The present invention will now be described, by way of example, with reference to the accompanying drawings, in which.

DESCRIPTION

Figure 1:
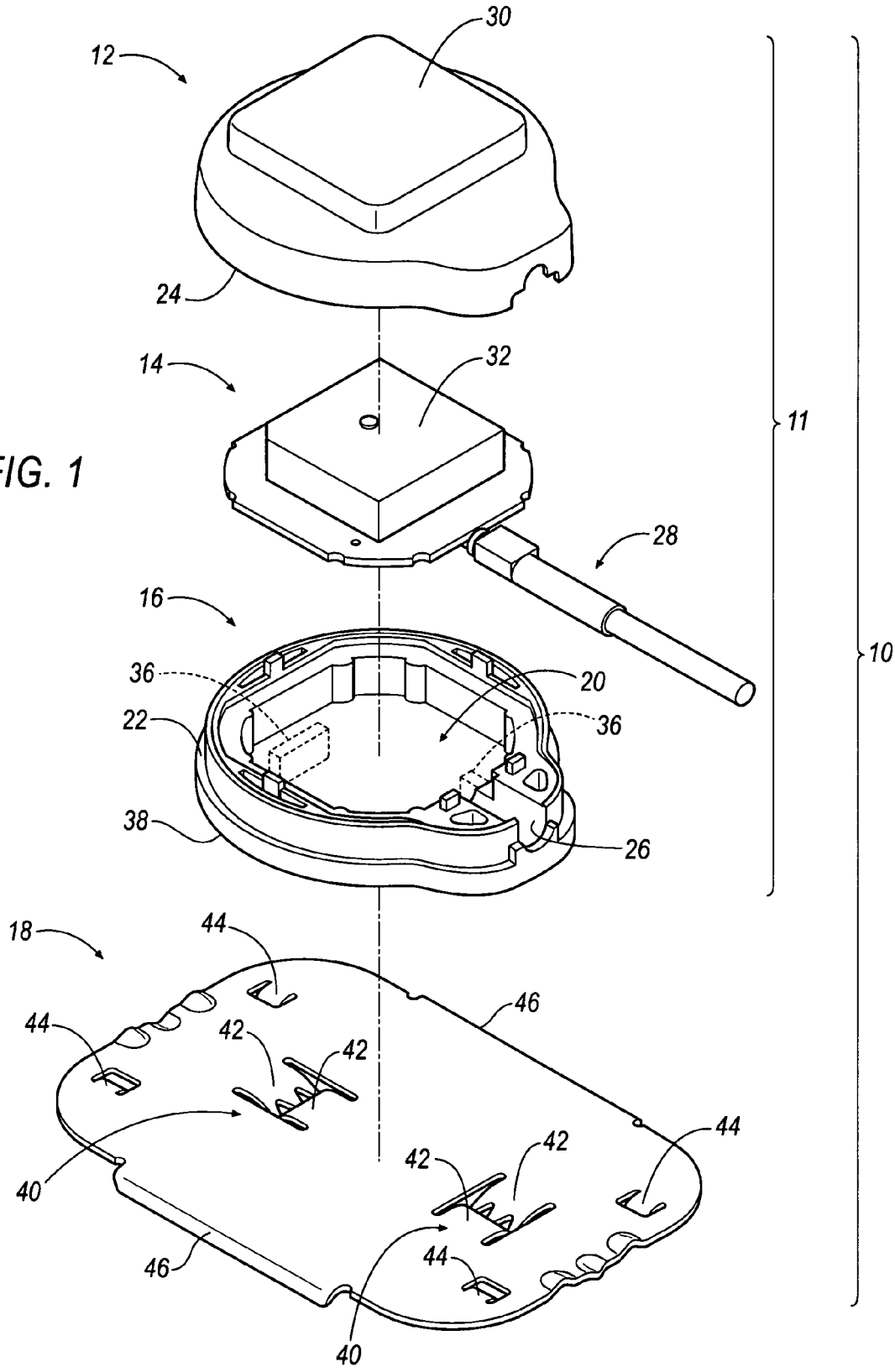
FIG. 1 is an exploded view of an antenna structure and assembly according to an embodiment.

An antenna assembly is shown generally at 10 and an antenna structure is shown generally at 11 in FIG. 1 according to an embodiment. The antenna structure 11 generally comprises a cover portion 12, a circuit board assembly 14, and a case 16. The antenna assembly generally comprises the antenna structure 11 and a metal ground plane 18. According to an embodiment, the antenna structure 11 is adapted to receive, but is not limited to, SDARS signals being broadcast on the 2320-2345 MHz frequency band.

The cover portion 12 may include any desirable thermoplastic material and may be formed using any desirable method, such as injection molding. The case 16 includes a metal impregnated thermoplastic resin, such as, for example, polycarbonate-Acrylonitrile-Butadiene-Styrene (PC/ABS), and may also be formed, for example, by injection molding. The metal elements impregnated in the PC/ABS may include, for example, nickel plated graphite fibers and/or carbon fiber segments, and be in the form of pellets, shavings, or fibers that are mixed with the PC/ABS material prior to the injection molding operation. When the antenna assembly 10 is activated, the metal elements in the case 16 provide a capacitive coupling between the circuit board assembly 14 and the vehicle roof (not shown) or ground plane 18.

Figure 2A:
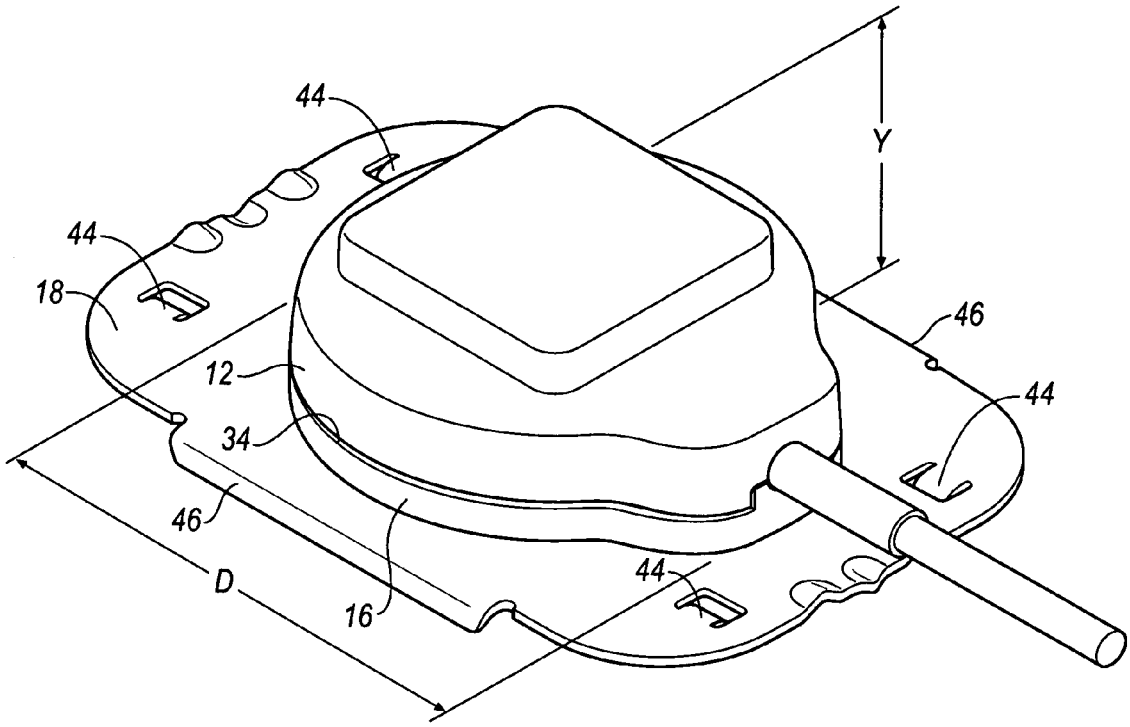
FIG. 2A is a top perspective view of the antenna structure and assembly according to FIG. 1.

As shown in FIG. 1, the case 16 includes a cavity portion 20 for receiving the circuit board assembly 14. The case 16 also includes a peripheral flange 22 that receives a bottom periphery 24 of the cover portion 12. The case 16 also includes a passage 26 for permitting extension of a cable 28 from the circuit board assembly 14. The cover portion 12 is shaped to include an embossed portion 30 for receiving a low noise amplifier and satellite patch antenna element 32 of the circuit board assembly 14. When placed over the peripheral flange 22 of the case 16, the cover portion 12 encapsulates the circuit board assembly 14. Once assembled as shown in FIGS. 2A and 2B, the peripheral flange 22 of the case 16 is ultrasonically welded to the bottom periphery 24 of the cover portion 12 to define a welded seam 34, which seals the circuit board assembly 14 from the elements, contaminates, and the like.

Figure 2B:
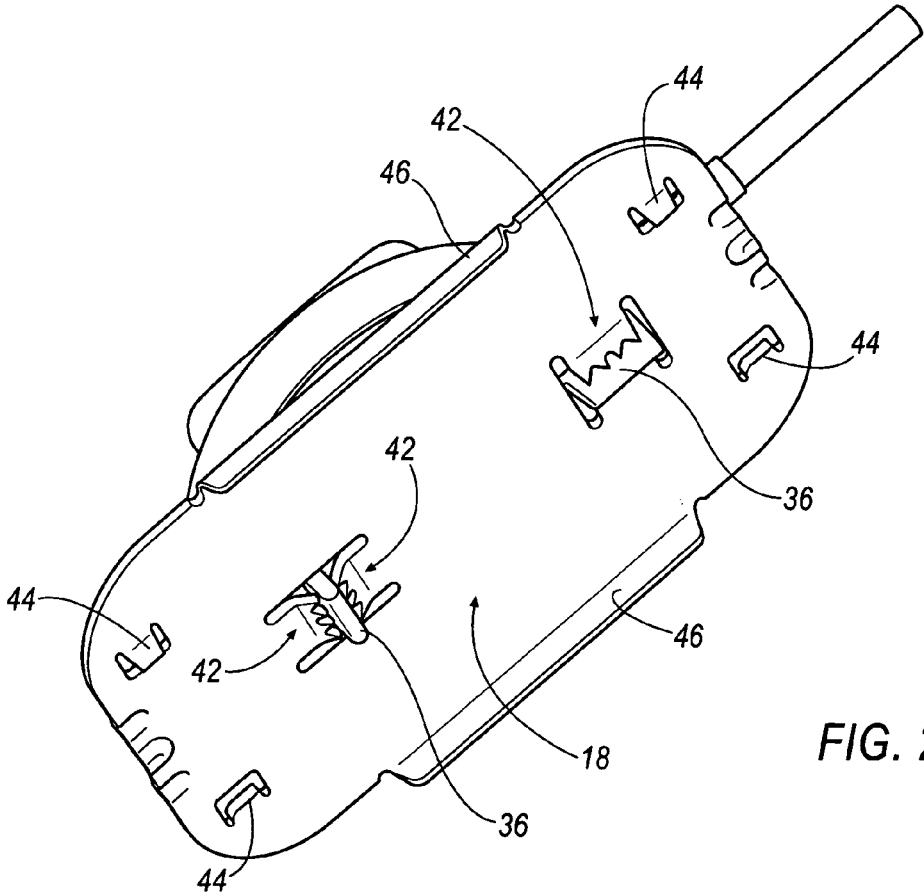
FIG. 2B is a bottom perspective view of the antenna structure and assembly according to FIG. 2A.

Referring to FIGS. 1 and 2B, the case 16 includes a pair of integrated fastening portions 36 that extend from a bottom portion 38 of the case 16. The integrated fastening portions 36 may be, for example, retention tabs that are adapted to extend through and be secured to the ground plane 18. The ground plane 18 includes resilient fastener receiving portions 40 that correspond to and permit passage and frictional retention of the integrated fastening portions 36. As illustrated, the fastener receiving portions 40 include a pair of flanges 42 that effectively bite into the integrated fastening portions 36. Although two integrated fastener portions 36 and fastener receiving portions 40 are shown, it will be appreciated that any desirable amount of integrated fastener portions 36 and corresponding fastener receiving portions 40 may be included in the design of the antenna assembly 10.

Figure 3:
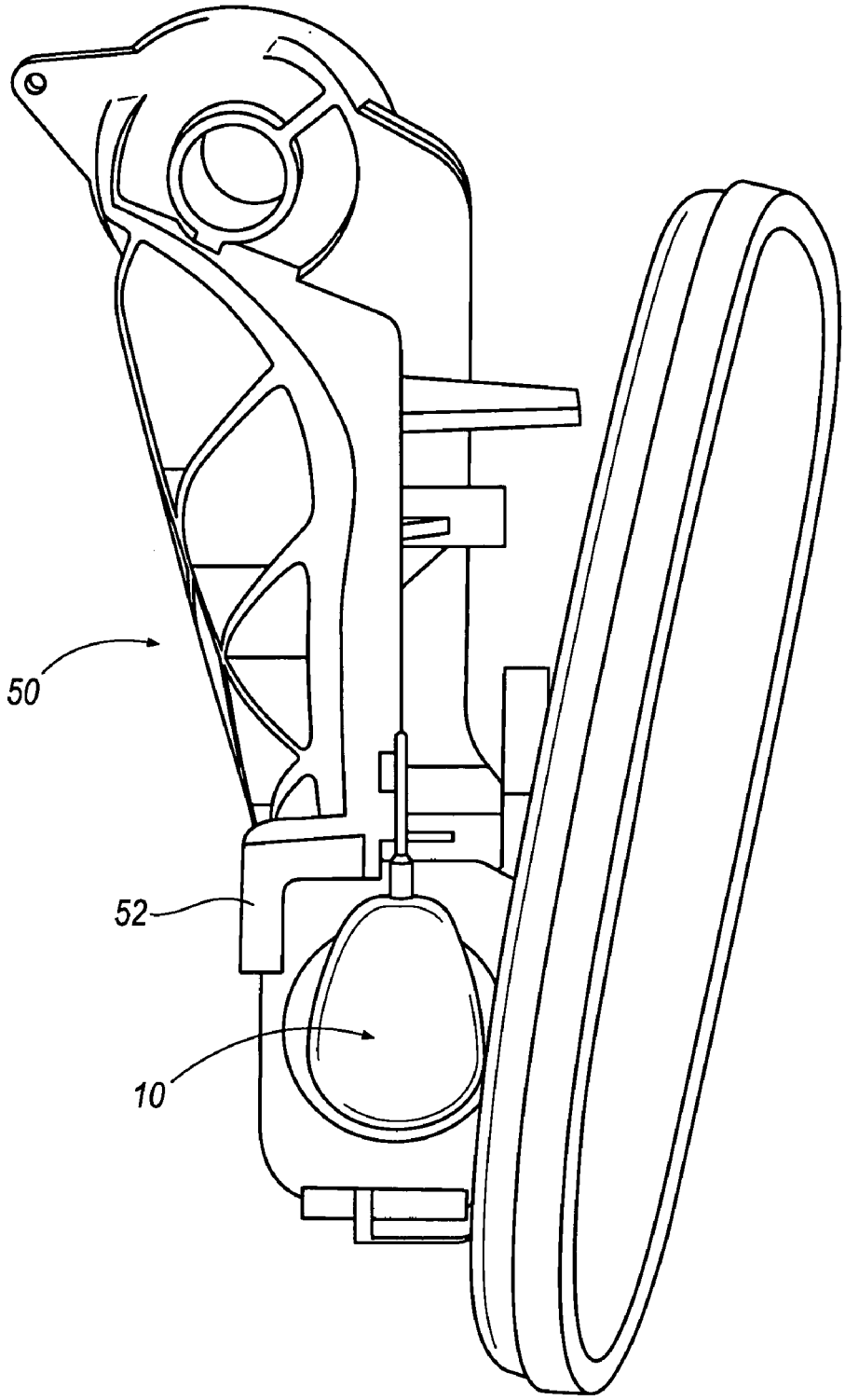
FIG. 3 is a top perspective view of a mirror frame adapted to receive the antenna structure and assembly according to FIGS. 1-2B.
Figure 4:
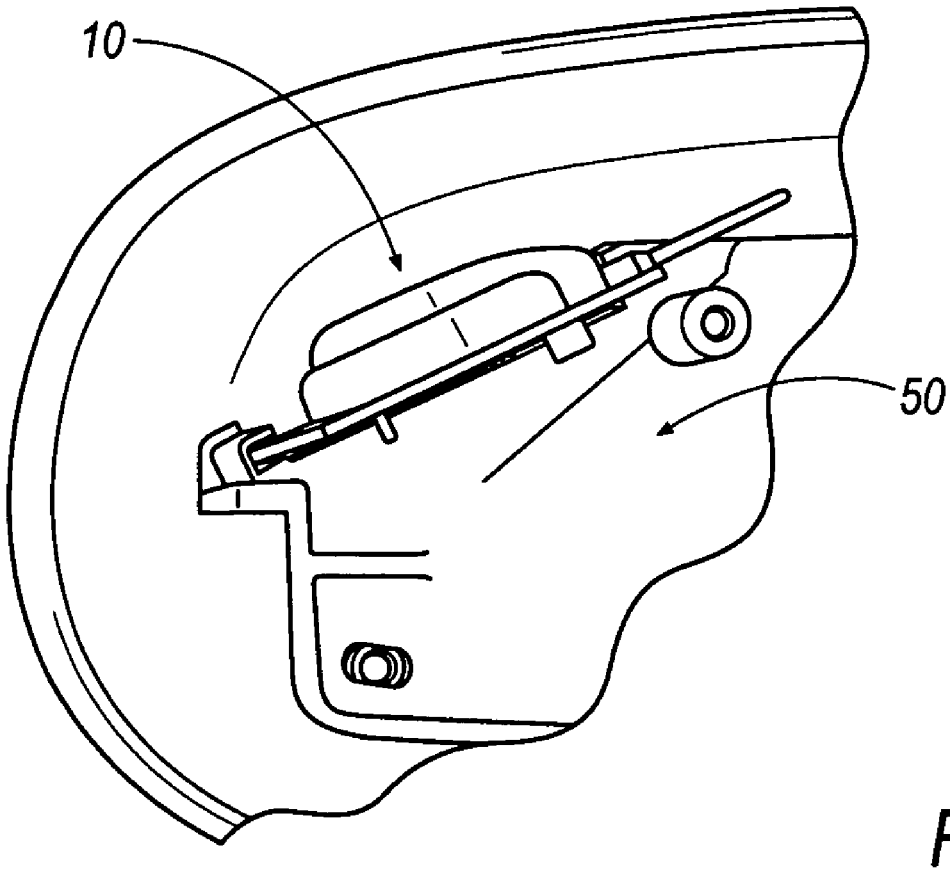
FIG. 4 is a view of the mirror frame and antenna structure and assembly according to FIG. 3.
Figure 5:
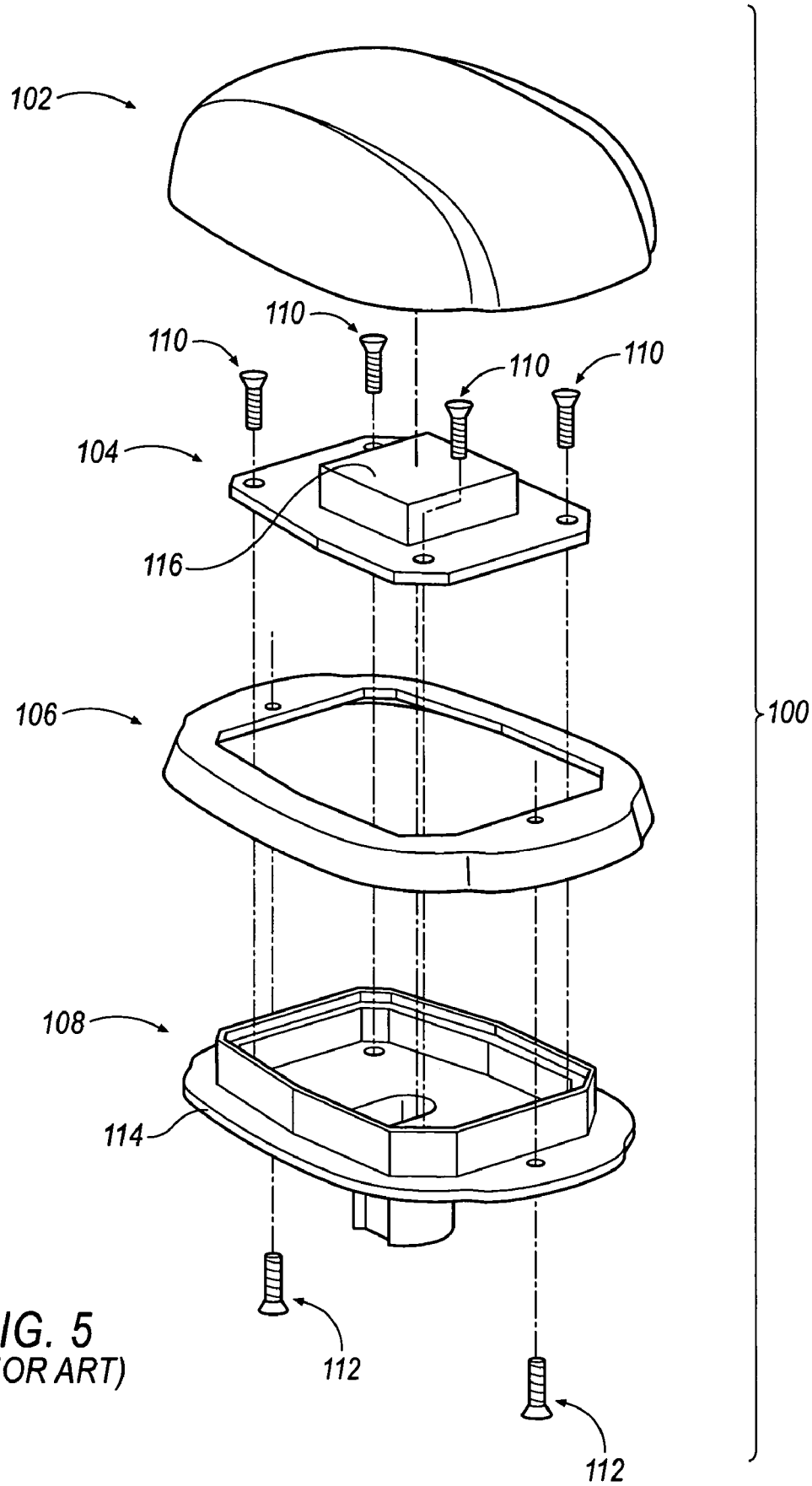
FIG. 5 (PRIOR ART)
FIG. 5 is an exploded view of a conventional antenna assembly.

Referring to FIGS. 1-2B, the ground plane 18 may further comprise a plurality of resilient tabs 44 and/or guide flanges 46 for securing the antenna assembly 10 to a structural element. As seen in FIGS. 3 and 4, the structural element may be a side-view mirror frame structure 50. Accordingly, the resilient tabs 44 and guide flanges 46 may engage a slot 52 formed in the structure 50 for retaining the antenna assembly 10. It will be appreciated that the resilient tabs 44 and flanges 46 may be orientated in any desirable fashion so as to allow the antenna assembly 10 to be orientated in any direction that maximizes performance of the antenna and/or to permit flexible routing of cables (not shown) that extend from the antenna assembly 10.

Although the antenna assembly 10 is shown to include a ground plane 18 that is attached to a side-view mirror structure 50 in FIGS. 3 and 4, it will be appreciated that the ground plane 18 may be eliminated and the case 16 of the antenna structure 11 may be placed adjacent to an alternate ground plane, such as a vehicle roof, using any desirable attaching method/procedure, such as, for example, magnetic coupling. Accordingly, if the case 16 is attached to the vehicle roof, the integrated fastening portions 36 may be eliminated from the design of the case 16. However, the integrated fastening portions 36 may, if desired, be extended through passages formed in the vehicle roof or another intermediate structure to improve retention of the antenna structure 11 to the vehicle roof.

Regardless of the ground plane that is selected for the antenna structure 11, a compact antenna structure 11 is realized in view of larger, conventional antenna assemblies 100. For example, as seen in FIG. 2A, the antenna structure 11, may generally include a diameter, D, approximately equal to 35.0 mm and a height, Y, approximately equal to 12.5 mm. Thus, because the general dimensions of the antenna structure 11 is relatively smaller than conventional assemblies, the antenna structure 11 may be placed at various sub-optimal locations within the structure of the vehicle (e.g., the side-view mirror structure, behind an instrument panel). As such, multiple antenna structures 11 may be incorporated on/into the vehicle for implementation in a diversity application where a plurality of antennas structures 11 are utilized to improve antenna performance. As is known in the art, if a first antenna in a diversity application loses reception of an expected signal, the diversity application will poll the other antennas in the application for expected signal reception and switch to a different antenna that is receiving the expected signal while the reception of the expected signal by the first antenna is temporarily unavailable.

Because the antenna structure 11 is ultrasonically welded, a reduction in parts is achieved since the conventional gasket 106 and first and second plurality of fasteners 110, 112 are not part of the antenna structure 11. Accordingly, cost of the antenna structure 11 is reduced in view of additional parts required to manufacture the conventional antenna assembly 100. Even further, the cost of manufacturing the antenna structure 11 is reduced in view of the elimination of multiple manufacturing steps previously associated with each first and second plurality of fasteners 110, 112 of the conventional antenna assembly 100. Yet even further, because the antenna structure 11 does not incorporate the use of the first and second plurality of fasteners 110, 112, which may be metallic screws, electrical interference associated with the metallic screws is also eliminated, thereby improving the performance of the antenna structure 11 in view of the conventional antenna assembly 100.

Although relatively light, elimination of the gasket 106 and first and second plurality of fasteners 110, 112 reduces the mass of the antenna structure 11. However, a greater reduction of the mass of the antenna structure 11 can be attributed to the design of the case 16 comprising metal-impregnated resin in view of the die-cast zinc material of the conventional case 108. Accordingly, if the antenna structure 11 is placed in a side-view mirror structure 50, unwanted stresses and/or displacement of the side-view mirror structure 50 is eliminated because the antenna structure 11 is significantly lighter than the conventional antenna assembly 100.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. An antenna assembly, comprising:

a ground plane;

a circuit board assembly including a low noise amplifier and satellite antenna; and a case that provides a capacitive coupling between the ground plane and the circuit board assembly, wherein the ground plane comprises at least one resilient fastener receiving portion that permits passage and frictional retention of at least one integrated fastening portion extending from the case, and a plurality of resilient tabs and/or guide flanges for securing the antenna assembly to a structural element.

2. The antenna assembly according to claim 1, wherein the structural element includes a slot formed in a side-view mirror frame structure.

3. The antenna assembly according to claim 1 further comprising a cover ultrasonically welded over the case for encapsulating said circuit board assembly, forming an antenna structure having a diameter approximately equal to 35 mm and a height approximately equal to 12.5 mm.

* * * * *